US006578343B1

(12) United States Patent
Dumler et al.

(10) Patent No.: US 6,578,343 B1
(45) Date of Patent: Jun. 17, 2003

(54) REINFORCED CONCRETE DECK STRUCTURE FOR BRIDGES AND METHOD OF MAKING SAME

(75) Inventors: Fred Dumler, Denver, CO (US); Richard L. Lawrence, Littleton, CO (US)

(73) Assignee: Pipe Service, Inc., Denver, CO (US); part interest ( * ) Notice: Subject to any disclaimer, the term of this patent is extended or adjusted under 35 U.S.C. 154(b) by 0 days.

(21) Appl. No.: 09/992,635

(22) Filed: Nov. 12, 2001

(51) Int. Cl.[7] ..... E04C 2/32; E04B 5/04; E04B 5/00; E04F 13/04; E01D 19/12

(52) U.S. Cl. ..... 52/783.17; 52/414; 52/452; 52/600; 14/73

(58) Field of Search ..... 52/783.17, 309.7, 52/309.2, 309.17, 452, 600, 405.3, 414, 794.1, 309.12, 612, 87, 88; 249/18, 19, 21; 14/73, 77.1

(56) References Cited

U.S. PATENT DOCUMENTS

| | | | | | |
|---|---|---|---|---|---|
| 23,877 | A | * | 5/1859 | Worthen | |
| 2,022,255 | A | * | 11/1935 | Scott | |
| 2,142,305 | A | * | 1/1939 | Davis | 52/592.1 |
| 2,934,934 | A | | 5/1960 | Berliner | |
| 3,603,221 | A | * | 9/1971 | Barton et al. | 404/31 |
| 3,956,864 | A | | 5/1976 | Fung | |
| 3,978,630 | A | * | 9/1976 | Labie | |
| 4,206,267 | A | | 6/1980 | Jungbluth | |
| 4,517,782 | A | | 5/1985 | Schamszadeh | |
| 4,558,550 | A | | 12/1985 | Marchais et al. | |
| 4,785,600 | A | | 11/1988 | Ting | |
| 4,832,309 | A | * | 5/1989 | Derby-Lewis | |
| 5,048,257 | A | | 9/1991 | Luedtke | |
| 5,235,791 | A | | 8/1993 | Yaguchi | |
| 5,311,629 | A | * | 5/1994 | Smith | |
| 5,440,845 | A | | 8/1995 | Tadros et al. | |
| 5,448,866 | A | | 9/1995 | Saito et al. | |
| 5,533,221 | A | * | 7/1996 | Majnaric | |
| 5,551,204 | A | * | 9/1996 | Mayrand | 52/795.1 |
| 5,802,652 | A | * | 9/1998 | Smith | |
| 5,845,457 | A | * | 12/1998 | Wybauw | 52/745.2 |
| 5,864,910 | A | * | 2/1999 | Mangone | |
| 5,966,764 | A | * | 10/1999 | Vodicka | |
| 6,000,194 | A | | 12/1999 | Nakamura | |
| 6,006,483 | A | | 12/1999 | Lee | |
| 6,145,270 | A | * | 11/2000 | Hillman | 52/731.1 |
| 6,223,495 | B1 | * | 5/2001 | Shaw et al. | 52/749.1 |

* cited by examiner

*Primary Examiner*—Carl D. Friedman
*Assistant Examiner*—Kevin McDermott
(74) *Attorney, Agent, or Firm*—John E. Reilly

(57) ABSTRACT

A reinforced concrete deck structure particularly adaptable for bridge spans is made up of superimposed layers of concrete with a corrugated metal pan therebetween along with a plurality of reinforcing bars which extend transversely of and through the corrugations. Individual, partially completed slabs are precast and are then placed on a bridge span and covered with a second layer.

17 Claims, 2 Drawing Sheets

REINFORCED CONCRETE DECK STRUCTURE FOR BRIDGES AND METHOD OF MAKING SAME

BACKGROUND AND FIELD OF INVENTION

This invention relates to concrete deck structures and methods of making same; and more particularly relates to a novel and improved reinforced concrete deck structure for bridges and to a novel and improved method of fabricating same.

Numerous types of reinforced concrete slabs have been devised as a part of structural assemblies, such as for example, for absorbing weight-bearing and moving loads. A typical application is in highway and railroad bridges where there is a need for a high strength deck structure which can be installed on top of the girders which form the upper span of the bridge.

Representative approaches to the construction of reinforced concrete slabs is U.S. Pat. No. 6,006,483 to Lee wherein the slab or deck is provided with a ribbed metal bottom plate and reinforcing bars are welded to lattice members which are in turn attached to a deck plate. U.S. Pat. No. 5,448,866 to Saito is directed to a solid metal pan formed of sheet steel with rebar affixed to the pan by strut members. U.S. Pat. No. 5,440,845 to Tadros et al provides a lower steel plate to support reinforcing bars as well as concrete in forming a reinforced concrete slab. Other patents of interest are U.S. Pat. No. 6,000,194 to Nakamura and U.S. Pat. No. 5,235,791 to Yaguchi.

It is desirable to provide for greatly enhanced structural stability in a reinforced concrete slab by employing a solid metal pan which is interposed between concrete layers of the slab and which further lends itself well to precasting in slab sections at a manufacturing site and then transporting to the desired installation site at which additional concrete layers can be poured to complete the assembly and in such a way as to eliminate separate lattice or strut portions as well as to achieve increased shear and compression strength.

SUMMARY OF THE INVENTION

It is therefore an object of the present invention to provide for a novel and improved reinforced concrete deck structure and method of fabricating same.

It is another object of the present invention to provide for a novel and improved reinforced concrete slab and to a method of making same in which the reinforcing layers are integrated into concrete layers of the slab in an improved, simplified and highly efficient manner.

A further object of the present invention is to provide for a reinforced concrete deck structure in which the reinforcement is composed of a solid metal pan in combination with reinforcing bars which will strengthen the deck structure both in compression and in shear.

It is a still further object of the present invention to provide for a novel and improved concrete deck structure for bridges and method of making same.

In accordance with the present invention, a reinforced concrete slab is made up of first and second layers of concrete in superimposed relation to one another and separated by a solid metal pan which has corrugations alternately extending into embedded relation to each of the layers. Preferably, reinforcing bars extend in spaced parallel relation to one another through the pan in a direction parallel to the layers but transversely of and through the corrugations or channels. The slab is specifically adapted for use as a deck for bridges, but has other useful applications.

A method of fabricating a reinforced concrete bridge slab to serve as a deck structure for a bridge which has a plurality of girders extending lengthwise of the bridge in accordance with the present invention comprises the steps of pouring a cementitious material into a generally rectangular form to a predetermined thickness and so as to cover a metallic pan in the bottom of the form having a plurality of corrugations or channels which are embedded into the first layer, inserting a plurality of reinforcing bars transversely of and through the corrugations or channels and through the first layer, and curing the first layer into a unitary reinforced concrete slab followed by turning the form over and removing the partially completed slab. After transporting the slabs to the installation site a second layer is applied after positioning the cured slabs on the girders with their pans exposed.

There has been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF PREFERRED EMBODIMENT

Figure 3:
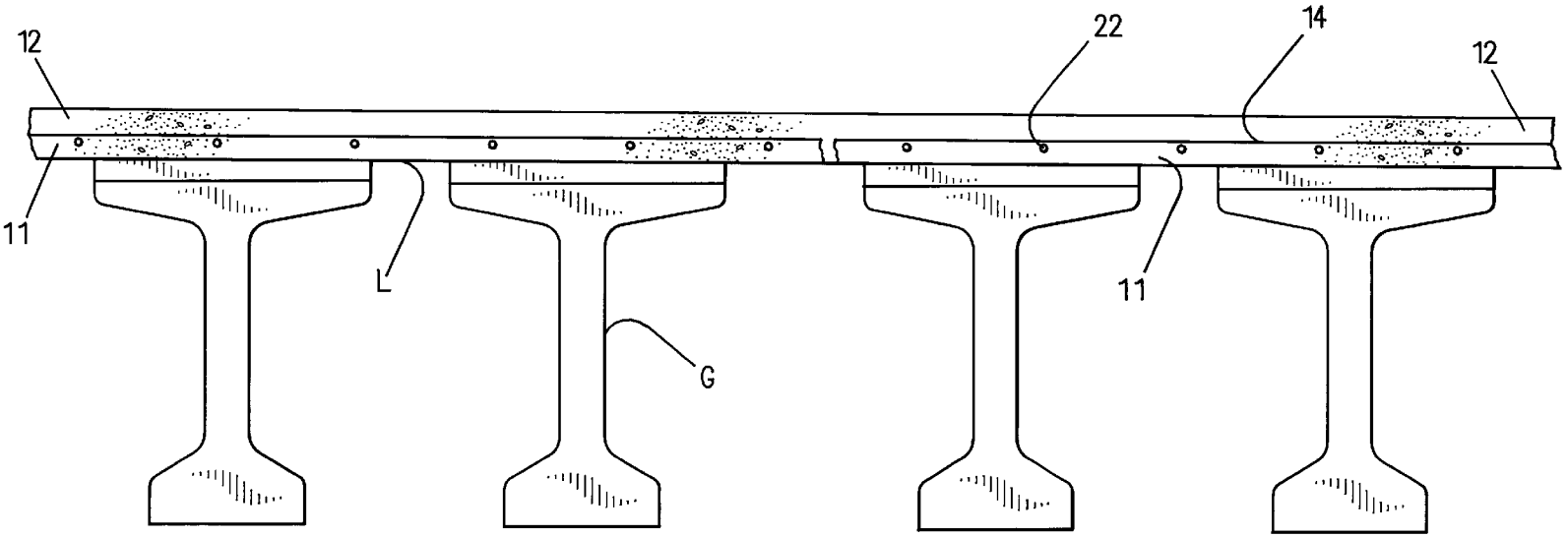
FIG. 3 is an elevational view of a plurality of concrete slabs mounted as a deck on a plurality of girders in a bridge span.

Referring in more detail to the drawings, there is shown by way of illustrative example in FIG. 3 the installation of a deck 10 constructed in accordance with the present invention on a plurality of spaced girders G of a highway bridge. It is to be understood that while the preferred form of deck 10 has particular utility on a bridge span it is adaptable for use as a concrete panel or deck structure in numerous other applications, such as, buildings, railway bridges, pedestrian bridges and walkways.

Figure 1:
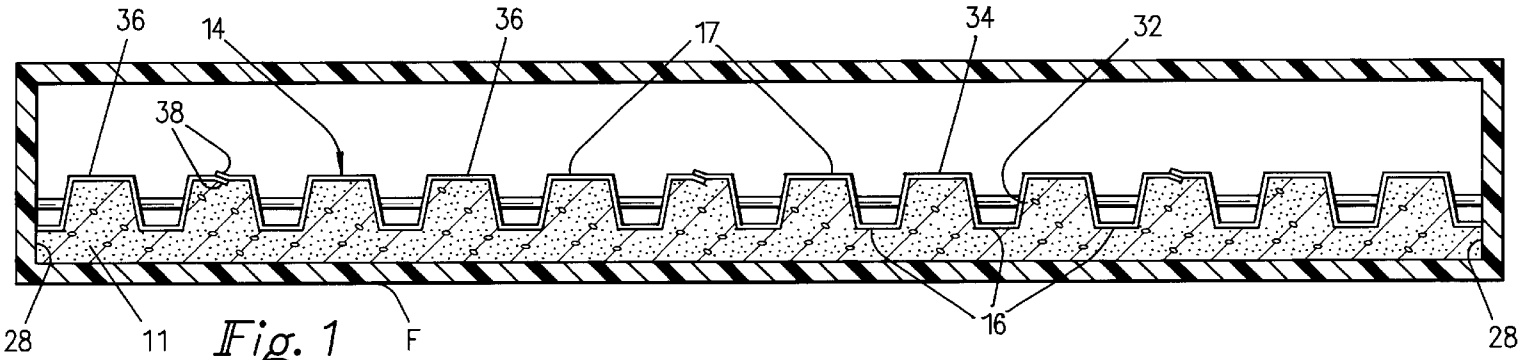
FIG. 1 is a cross-sectional view of a portion of the concrete slab assembly positioned in a form.
Figure 2:
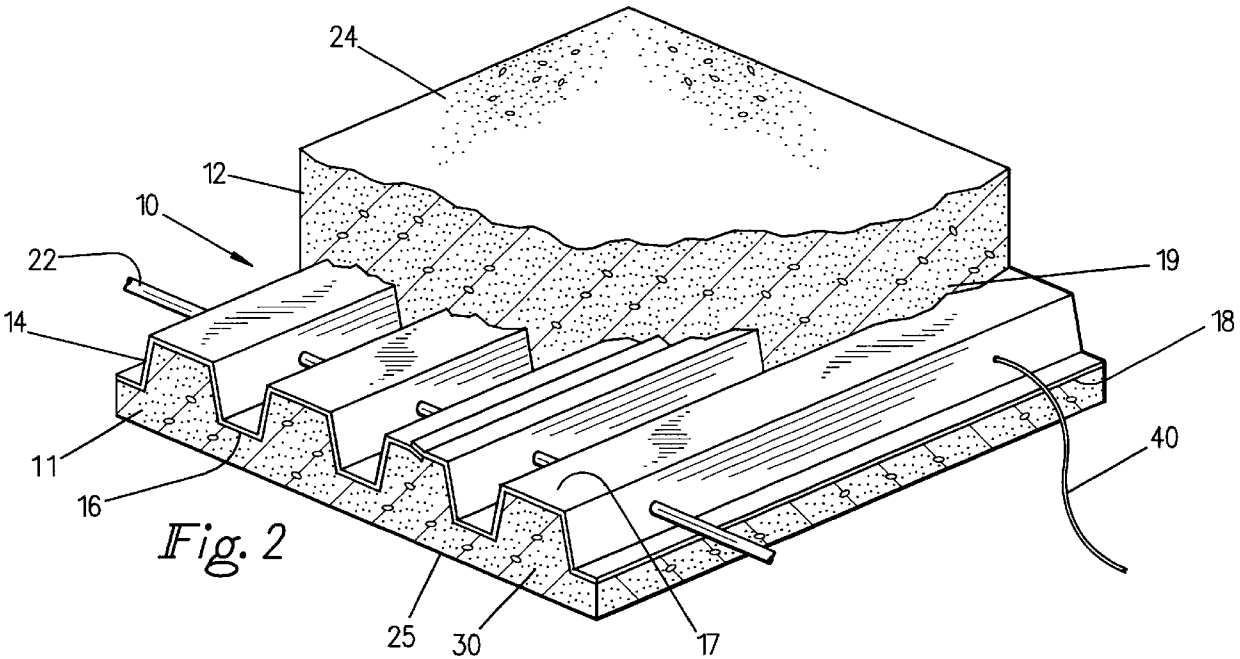
FIG. 2 is a perspective view of the completed slab assembly with portions broken away to illustrate the preferred form of invention.

The preferred form of invention is illustrated in more detail in FIGS. 1 and 2 in which the reinforced concrete slab 10 is broadly comprised of first and second layers of concrete 11 and 12 in superimposed relation to one another, a solid metal pan 14 interposed between the layers 11 and 12, the pan having corrugations or channels 16 and 17 alternately extending in opposite directions into embedded relation to confronting surface portions 18 and 19 of the layers 11 and 12, respectively.

A plurality of reinforcing rods or bars 22 extend in spaced parallel relation to one another through the pan 14 and in a direction transversely of and through intermediate portions of the corrugations or channels.

Preferably, the pan 14 is a thin-walled steel material, such as, an ASTM A653 Grade 80 steel, and the reinforcing bars 22 are steel bars. When assembled together with the concrete layers 11 and 12, the entire slab is of generally rectangular configuration having flat parallel top and bottom surface 24 and 25, opposite side edges 28 and opposite ends 30. The pan 14 is coextensive with the layers 11 and 12 with the corrugations or channels 16 and 17 extending between the opposite ends 30 and parallel to the side edges 28. Preferably, the corrugations or channels are of generally trapezoidal cross-sectional configuration having convergent side walls 32 which terminate in a flat end surface 34. Depending upon the size of each slab or deck, the pan 14 is made of a plurality of sections 36 having overlapping edges 38 which are securely by joined together. The edges 38 run parallel to the corrugations or channels as best seen from FIG. 2.

Figure 1A:
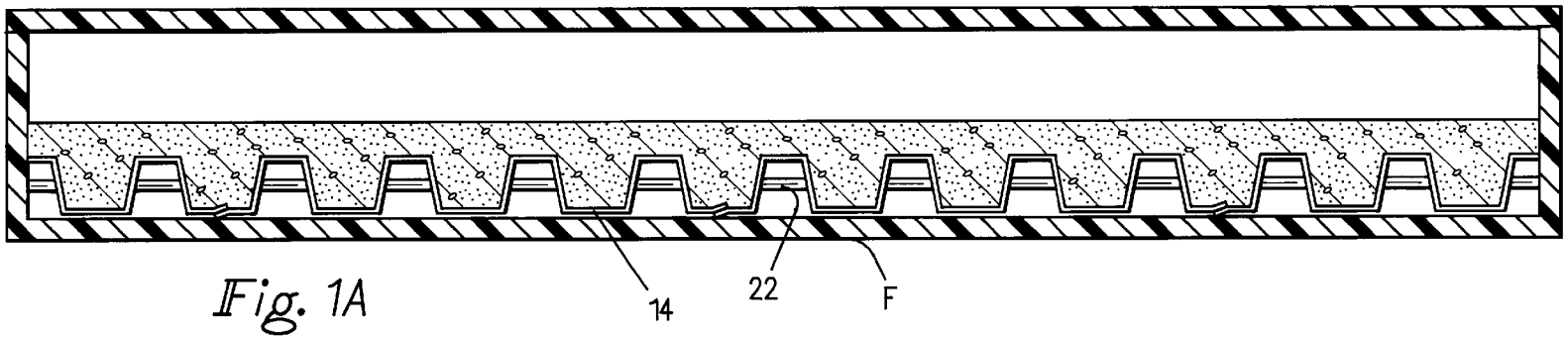
FIG. 1A is another cross-sectional view illustrating the reverse positioning of the pan of the preferred form of slab in the form as a preliminary to pouring of the first layer of cementitious material.

The fabrication of the deck 10 for bridge structures is initiated at a manufacturing site. As shown in FIGS. 1 and 1A, a form F of shallow rectangular configuration is provided having the desired dimensions of the deck 10. The pan 14 is placed in the bottom of the form as shown in FIG. 1A, and a cementitious material is then poured into the form to the desired thickness while at the same time completely filling the channels 17. The reinforcing bars 22 are inserted through the channels 16, 17 and that portion of concrete between the channels and the first layer 11 permitted to harden or cure. The form F is then flipped over or reversed into the position shown in FIG. 1 with the pan 14 on top of the concrete layer 11. The pan may then be easily removed from the form F by grasping the reinforcing rods and lifting from the form F. The partially completed slabs are then transported to the bridge site. For example, for a bridge span, the partially completed slabs would be placed on the girders in abutting relation to one another with the pans facing upwardly or exposed and the corrugations or channels 14 extending perpendicular to the girders G. The second layer 12 is then poured over the partially completed slabs so as to form the desired thickness of the second or upper layer 12. The sides or outer edges of the bridge span are confined using a conventional slip form and a conventional sheet or layer as represented at L in FIG. 3 is placed beneath the slabs to prevent the cementitious material from spreading or leaking beneath the slabs but will substantially fill any spaces between the slabs. The concrete layer 12 is then permitted to harden in place.

A particular advantage of the fabrication and installation of the deck 10 is the ability to precast the first layer 11 in uniform surrounding relation to one side of the pan 14 and reinforcing bars 22 and eliminate any spaces or voids between the concrete and pan. The second layer when poured at the installation site will correspondingly fill the corrugations 16 on the opposite side so as to eliminate any spaces or voids and, once cured, will result in a structure having much improved shear strength owing primarily to the integration of the pan and reinforcing bars into the slab and running the corrugations 16 and 17 in a direction perpendicular to the girders. Various cathodic protection devices may be employed and incorporated into the deck structure to prevent or minimize corrosion all in accordance with well-known practice. For this purpose, a wire lead 40 extends from the pan 14 for connection to an anode, not shown. A typical slab dimension would be on the order 8'×8' and having a total thickness of 8" to 9" It will be understood however that these dimensions may vary according to intended application and load-bearing capacity or requirements. Similarly, the relative depth or thickness of the concrete layers 11 and 12 are well as thickness of the pan 14 may vary according to intended use.

It is therefore to be understood that while preferred deck structure and method of forming same are herein set forth and described, the above and other modifications and changes may be made therein without departing from the spirit and scope of the present invention.

We claim:

1. A reinforced concrete slab comprising first and second layers of concrete in superimposed relation to one another, including top and bottom surfaces in space parallel relation to one another and a pan interposed between said layers, said pan having corrugations alternatively extending into embedded relation to confronting surfaces of said first and second layers wherein said first and second layers each have a plurality of complementary corrugations to those of said pan, and reinforcing rods extending transversely of and through said corrugations between opposite ends of said layers.

2. A slab according to claim 1 wherein said layers are of generally rectangular configuration.

3. A slab according to claim 2 wherein said reinforcing rods extend in spaced parallel relation to one another through said pan in a direction parallel to said top and bottom surfaces of said layers.

4. A slab according to claim 1 wherein said pan is comprised of a plurality of solid metal sheets having adjoining edges interconnected to one another.

5. A slab according to claim 1 wherein said pan is composed of a thin-walled metallic material and is coextensive with said layers.

6. A slab according to claim 5 wherein each of said corrugations is of trapezoidal configuration.

7. A reinforced bridge slab comprising first and second continuous layers of concrete in superimposed relation to one another including top and bottom surfaces in spaced parallel relation to one another, a solid pan interposed between and coextensive with said layers, said pan having corrugations alternately extending in opposite directions into embedded relation to said confronting surfaces of said layers wherein said first and second layers each have a plurality of complementary corrugations to those of said pan, and reinforcing bars extending in spaced parallel relation to one another transversely of and through said corrugations in a direction parallel to said top and bottom surfaces of said layers.

8. A reinforced bridge slab according to claim 7 wherein said layers and said pan are of generally rectangular configuration and are in coextensive relation to one another.

9. A reinforced bridge slab according to claim 7 wherein said pan is comprised of a plurality of solid metal sheets having adjoining edges interconnected to one another.

10. A reinforced bridge slab according to claim 7 wherein said pan is composed of a thin-walled metallic material and is coextensive with said layers.

11. A reinforced bridge slab according to claim 10 wherein each of said corrugations is of generally trapezoidal configuration.

12. A reinforced bridge slab according to claim 11 wherein said pan is composed of steel.

13. The combination of a bridge having an upper support structure made up of a plurality of girders extending lengthwise of said bridge in spaced parallel relation to one another, and a plurality of concrete slabs positioned on said girders, each of said slabs comprising first and second layers of concrete in superimposed relation to one another, a metallic pan interposed between said concrete layers, said pan having corrugations alternately extending upwardly and downwardly into embedded relation to said concrete layers, said corrugations extending in a direction transversely of said girders, and reinforcing steel bars extending in spaced parallel relation to one another transversely of and through said corrugations.

14. The combination according to claim 13 wherein said slabs are characterized by having a unitary second layer.

15. The combination according to claim 13 wherein said corrugations are of generally trapezoidal configuration.

16. A method of fabricating reinforced concrete bridge slabs to serve as a deck structure for a bridge which has a plurality of girders extending lengthwise of the bridge comprising the steps of:

placing a metallic pan having a plurality of corrugations in closely spaced parallel relation to one another in a generally rectangular form;

pouring a cementitious material into said form whereby to completely cover said pan and fill said corrugations as well as to fill said form above said corrugations to a selected thickness so as to result in a partially completed slab;

curing said partially completed slab;

transporting a plurality of said partially completed slabs to a bridge site and positioning said slabs on said girders in abutting relation to one another with said pans defining upper surfaces of said slabs;

applying a second layer of cementitious material to said slabs whereby to completely fill said corrugations and any spaces or voids between abutting edges of said slabs as well as to form a layer above said corrugations of a selected thickness; and curing said second layer.

17. The combination of a bridge having an upper support structure made up of a plurality of girders extending lengthwise of said bridge in spaced parallel relation to one another, and a plurality of concrete slabs positioned on said girders, each of said slabs comprising first and second layers of concrete in superimposed relation to one another, a metallic pan interposed between said concrete layers said pan having corrugations alternately extending upwardly and downwardly into embedded relation to said concrete layers, and reinforcing steel bars extending in spaced parallel relation to one another transversely of and through said corrugations.

* * * * *